US009150973B2

(12) United States Patent
Teng et al.

(10) Patent No.: US 9,150,973 B2
(45) **Date of Patent: *Oct. 6, 2015**

(54) PROCESS FOR RECOVERING METALS AND AN ELECTROLYTIC APPARATUS FOR PERFORMING THE PROCESS

(75) Inventors: Lidong Teng, Västerås (SE); Seshadri Seetharaman, Täby (SE); Sridhar Seetharaman, Rugby (GB)

(73) Assignee: JERNKONTORET AB, Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 14/238,739

(22) PCT Filed: Aug. 17, 2012

(86) PCT No.: PCT/SE2012/050884

§ 371 (c)(1), (2), (4) Date: Mar. 4, 2014

(87) PCT Pub. No.: WO2013/028126

PCT Pub. Date: Feb. 28, 2013

(65) Prior Publication Data

US 2014/0166502 A1 Jun. 19, 2014

(30) Foreign Application Priority Data

Aug. 19, 2011 (SE) ..... 1100604

(51) Int. Cl.
*C25C 1/18* (2006.01)
*C25C 3/00* (2006.01)
(Continued)

(52) U.S. Cl.
CPC ... *C25C 3/00* (2013.01); *C25B 1/00* (2013.01); *C25C 3/06* (2013.01); *C25C 3/08* (2013.01); *C25C 3/26* (2013.01); *C25C 3/28* (2013.01); *C25C 3/32* (2013.01); *C25C 7/005* (2013.01)

(58) Field of Classification Search
USPC ..... 205/367–401
See application file for complete search history.

(56) References Cited

U.S. PATENT DOCUMENTS 4,159,928 A 7/1979 Tsumura
4,209,501 A 6/1980 Kruesi
(Continued)

FOREIGN PATENT DOCUMENTS

JP 61-050688 3/1986
JP 05-185064 7/1993
(Continued)

OTHER PUBLICATIONS

Hryn et al., A Dynamic Inert Metal Anode, Mar. 4, 1999, paper presented at the 128th Annual Meeting of The Minerals, Metals and Materials Society pp. 1-5.*
(Continued)

*Primary Examiner* — Arun S Phasge
(74) *Attorney, Agent, or Firm* — Jeffrey S. Melcher; Manelli Selter PLLC

(57) ABSTRACT

A process for recovering at least one metal from a metal containing resource, in particular containing at least one metal oxide. The process including the step: providing a crucible containing a chloride salt melt, at least one cathode and an anode connected to the salt melt, heating means for heating the salt melt, and an aluminum melt present at the bottom of the crucible, said aluminum melt forming a part of the anode.

21 Claims, 1 Drawing Sheet

(51) Int. Cl.

| | |
|---|---|
| ***C25C 3/06*** | (2006.01) |
| ***C25C 3/08*** | (2006.01) |
| ***C25C 3/26*** | (2006.01) |
| ***C25C 3/28*** | (2006.01) |
| ***C25C 3/32*** | (2006.01) |
| ***C25C 7/00*** | (2006.01) |
| ***C25B 1/00*** | (2006.01) |

(56) References Cited

U.S. PATENT DOCUMENTS

| | | | | |
|---|---|---|---|---|
| 4,273,627 | A | 6/1981 | Dawless | |
| 4,475,993 | A | 10/1984 | Blander | |
| 4,853,094 | A * | 8/1989 | Honders et al. | 205/363 |
| 6,402,910 | B1 | 6/2002 | Putter | |

FOREIGN PATENT DOCUMENTS

| | | |
|---|---|---|
| JP | 7-037509 | 2/1995 |
| JP | 7-45198 | 2/1995 |
| JP | 9-115449 | 2/1997 |
| JP | 9-193762 | 7/1997 |
| JP | 2008200563 | 9/2008 |
| WO | 2009139715 | 11/2009 |
| WO | 2009139715 A1 | 11/2009 |

OTHER PUBLICATIONS

International Search Report issued in PCT/SE2012/050885, Nov. 13, 2012, pp. 1-3.
Journal of Hazardous Materials 161(1109-1113) Issus 2/3 2009.
Written Opinion issued in PCT/SE2012/050885, Aug. 17, 2012, pp. 1-5.
International Search Report issued in PCT/SE2012/050884, Dec. 14, 2012, pp. 1-5.
Sanders, "Aluminum and Aluminum Alloys," Kirk-Othmer Encyclopedia of Chemical Technology, published online: Oct. 19, 2012, pp. 18-19.
International Preliminary Report on Patentability issued in PCT/SE2012/050884, Feb. 25, 2014, pp. 1-7.
Written Opinion issued in PCT/SE2012/050884, Dec. 14, 2012, pp. 1-6.
International Preliminary Report on Patentability issued in PCT/SE2012/050885, Feb. 18, 2014, pp. 1-6.
Rejection Notice issued in Japanese Patent Application No. 2014-527116, Aug. 27, 2014, pp. 1-4.
Communication issued in European Patent Application No. 12825764.9, Feb. 26, 2015, pp. 1-5.

* cited by examiner

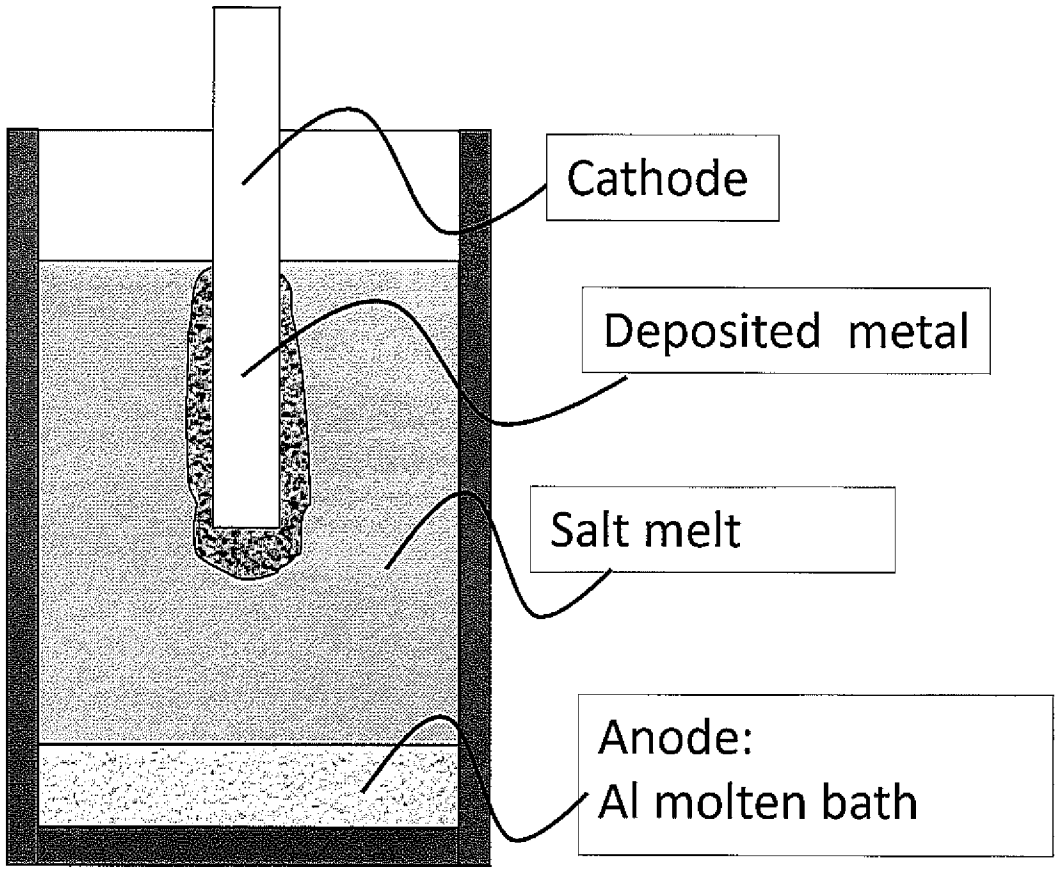
Cathode
Deposited metal
Salt melt
Anode:
Al molten bath

PROCESS FOR RECOVERING METALS AND AN ELECTROLYTIC APPARATUS FOR PERFORMING THE PROCESS

TECHNICAL FIELD

The invention relates to a process for recovering at least one metal from a metal containing resource, in particular containing at least one metal oxide.

The invention also relates to an electrolytic apparatus for performing such processes.

BACKGROUND

It is well known that metal values can be recovered from many sources such as scrap, ores and sea nodules by chlorination. The formed metal chlorides can subsequently be separated and extracted by fractional distillation and condensation, electrolysis of the salt or by hydrometallurgical processing.

WO 2009/139715 A1 discloses a process for chlorinating ore, slag, mill scale, scrap, dust and other resources containing recoverable metals from the groups 4-6, 8-12, and 14 in the periodic table. However, to get a considerably higher reaction rate and yield of valuable metals than what is possible when ferric chloride and/or cupric chloride are used as chlorine donors, aluminum chloride is substituted for said chlorides.

OBJECTS OF THE INVENTION

One object is to provide a process for recovering at least one metal from a metal containing resource such as ore, slag, mill scale, scrap, dust, glass, electronic waste material.

Another object of the invention is to provide a cost efficient process for recovering at least one metal from a metal containing resource.

Another object is to provide a process for recovering at least one metal from a metal containing resource, which minimizes environmental impact.

Another object is to provide an apparatus for performing said process.

BRIEF DESCRIPTION

At least one of the objects mentioned above is achieved by a process for recovering at least one metal from a metal containing resource, in particular containing at least one metal oxide, said process including the steps of:

a) providing a crucible containing a chloride salt melt, at least one cathode and an anode connected to the salt melt, heating means for heating the salt melt, and an aluminum melt present at the bottom of the crucible, said aluminum melt forming the anode or a part of the anode, b) providing an initiating chlorine donor to the salt melt for starting the reactions in the salt melt, said initiating chloride donor being aluminum chloride and/or at least one metal chloride that can be electrolyzed in step f) to form aluminum chloride, c) holding the temperature of the salt melt and the temperature of the aluminum melt at a temperature where both are in liquid phase, d) introducing said metal containing resource into the liquid salt melt, e) reacting the aluminum chloride as a chlorine donor with the metal containing resource to form at least one metal chloride being dissolved in the salt melt, f) electrolyzing the salt melt, thereby forming the at least one metal at the cathode, optionally using a cathode bag, and forming aluminum chloride at the contact surface between the aluminum melt and the salt melt, recovering at least one metal from the salt melt.

Preferably the cathode is at least one first graphite electrode immersed in the salt melt. However, electrodes in other materials can also be used.

In one embodiment the crucible is at least partly made in a conductive material, said conductive material being in contact with aluminum melt. The crucible is connected to positive polarity during the electrolysis.

Alternatively, a second graphite electrode is immersed in the aluminum melt, and said second graphite electrode is connected to positive polarity during the electrolysis.

Preferably the salt melt and the aluminum is held at a temperature above 660° C., preferably between 700° C., and 1000° C., more preferably below 900° C.

Preferably electrolyzing includes selectively electrodepositing of the at least one metal.

Preferably the metal oxide containing resource is introduced into said liquid salt melt stepwise or continuously, as it is being dissolved.

Preferably, the process is partly or wholly self-supporting during steady state by the aluminum chloride formed during the electrolyzing.

Preferably the salt melt initially consists of a) 70-99% by weight of at least one chloride salt selected from the group consisting of alkali metal chlorides and alkaline earth metal chlorides, preferably 70-95% by weight, b) 1-20% by weight of the initiating chloride donor, preferably 5-20% by weight, and c) optionally 0-10% by weight of additional chlorides, and/or other halides, and/or sulfides and/or oxides.

For given salt combination of the least two chloride salts, it is preferred that the contents of the salts are within 10% by weight from the lowest eutectic point of the salt combination, more preferably within 5% by weight, most preferably within 1% by weight. However, other contents may be used as long as the liquidus temperature of the salt combination is at least 50° C. lower than the operating temperature during electrolyzing; preferably 100° C. lower than the operating temperature.

Preferably, the at least one chloride salt, partly or wholly consist of at least one of the salts selected from the group: NaCl, KCl, LiCl, $CaCl_2$, preferably at least two of the salts selected from the group: NaCl, KCl, LiCl, $CaCl_2$, more preferably at least three of the salts selected from the group: NaCl, KCl, LiCl, $CaCl_2$.

In preferred embodiment the at least one chloride salt includes by weight % of the at least one chloride salt, 3-20 Na, 30-70 KCl, 20-60 LiCl, preferably 5-15 Na, 40-60 KCl, 30-50 LiCl, more preferably 7-12 NaCl, 45-55 KCl, 35-45 LiCl.

In an alternative embodiment the at least one chloride salt includes by weight % of the at least one chloride salt, 10-50 NaCl, 2-20 KCl, 50-80 $CaCl_2$ preferably 25-35 NaCl, 3-10 KCl, 60-75 $CaCl_2$.

In an alternative embodiment the at least one chloride salt includes by weight % of the at least one chloride salt, 5-20 NaCl, 20-40 LiCl, 40-70 $CaCl_2$ preferably 7-15 NaCl, 25-35 LiCl, 50-60 $CaCl_2$.

In an alternative embodiment the at least one chloride salt includes by weight % of the salt composition, 35-65 KCl, 20-50 LiCl, 5-20 $CaCl_2$ preferably 45-55 KCl, 30-40 LiCl, 10-15 $CaCl_2$.

In an alternative embodiment the electrolyzing is performed for 2 to 8 hours, preferably 3-6 hours.

Preferably, grinding and/or milling the metal containing resource to a powder before introducing it to the salt melt. Preferably the powder has a size distribution where D90 is less than 2 mm.

Optionally, dehydrating the metal containing resource before introducing it to the salt melt.

Optionally carbon dioxide can be added to the salt melt in order to control the oxygen partial pressure.

The process steps mentioned above can also be used for reducing chloride emissions when recovering at least one metal from a metal containing resource, in particular containing at least one metal oxide. Examples of resources are ore, slag, mill scale, scrap, dust, glass, electronic waste material. This can be achieved since the chloride ions forms aluminum chloride at the anode during the electrolyzing step; thereby partly or wholly reducing the formation of chloride gas.

At least one of the objects mentioned above is achieved by electrolytic apparatus for performing the above described process. Said apparatus comprising a crucible containing a salt melt, at least one cathode, an anode, and heating means for heating the salt melt, wherein an aluminum melt is present at the bottom of the crucible, said salt melt forming a part of the anode.

If a metal that is liquid at the operating temperature of the electrolysis, the electrolytic apparatus can be provided with a cathode bag around the cathode for collecting liquid metal. Such cathode bag is preferably made from alumina and has preferably a plurality of holes.

The heating means can be any kind of heating means commonly used in metallurgical processes or processes for heating salt melts.

BRIEF DESCRIPTION OF THE DRAWINGS

FIG. 1 shows a schematic setup of the apparatus for recovering metals.

DESCRIPTION

The salt melt and the aluminum are heated to a temperature where both are in liquid phase. To improve viscosity of the salt melt the temperature of the salt melt is preferably at least 50° C. above the liquidus temperature of the salt melt, more preferably at least 100° C. above liquidus temperature of the salt melt. The temperature should be at least 660° C. and not more than 1000° C., preferably the temperature is in the range of 700-900° C.

To start the reactions, the 5-20 wt % of an initiating chloride donor is added to the salt melt. The initiating chloride donor is preferably aluminum chloride, but it could also be one or more metal chlorides that are electrolyzed to form aluminum chloride with the aluminum melt.

In a first embodiment of the invention, schematically exemplified by FIG. 1, a first graphite electrode is immersed in the salt melt. During the electrolysis the first graphite electrode is connecting to negative polarity and the crucible to positive polarity. The crucible being at least partly made of a conductive material which in contact with the aluminum melt. Thereby the first cathode operates as a cathode, whereas the crucible and the molten aluminum operate as an anode. Thus the first graphite electrode and the crucible are connected to a DC source. The voltage is depends on which metal to extract, and is typically around 1 volt above the decomposition voltage of the corresponding metal chloride. Different metals can be deposited by selective electrodepositing methods.

$AlCl_3$ acts as a chlorine donor dissolving metal oxides to metal chlorides in the salt melt. The following reaction occurs between $AlCl_3$ and metal oxide/s in the salt melt $$3MO_X+2XAlCl_3 \rightarrow 3MCl_{2x}+XAl_2O_3 \quad (1)$$

During the electrolysis metals/s from metal chloride/s is deposited at the cathode. At the contact surface between the salt melt and the aluminum melt chlorine ions are reacting with aluminum, thereby forming $AlCl_3$. This means that during steady state the salt melt can be wholly or partly self-supporting in regards of $AlCl_3$ and also that emission of chloride gas is reduced.

$$Al^{3+}+3Cl^- \rightarrow AlCl_3 \quad (2)$$

$$M^{2x+}+2x\,e^- \rightarrow M \quad (3)$$

At the cathode metal/s are deposited in solid or liquid state for metal/s with lower melting point than the temperature of the salt melt. For collecting liquid metal, e.g. lead, a pervious cathode bag may be provided around the cathode. The cathode bag suitably is made from alumina and has a plurality of holes, through which the ions can pass. The holes may be cuts extending in the circumferential direction.

As the metal oxide/s of the metal oxide containing resource is consumed, more metal oxide/s can be stepwise or continuously added to the salt melt. The electrolysis can for instance be performed for 2-8 hours; where after metals deposited at the cathode/s is collected. The residue after processing contains $Al_2O_3$ and for instance other stable oxides such as $SiO_2$, depending on the contents of the metal oxide containing resource. For instance CRT glass contains $SiO_2$. The residues may for instance be used for landfill, building construction or as a raw material for the refractory industry.

Metals that can be recovered include metals from the groups 4-14 in the periodic table, e.g. metals from the group: titanium (Ti), zirconium (Zr), hafnium (Hf), vanadium (V), niobium (Nb), tantalum (Ta), chromium (Cr), molybdenum (Mo), tungsten (W), manganese (Mn), technetium (Tc), rhenium (Re), iron (Fe), ruthenium (Ru), osmium (Os), cobalt (Co), rhodium (Rh), iridium (Ir), nickel (Ni), palladium (Pd), platinum (Pt), copper (Cu), silver (Ag), gold (Au), zinc (Zn), cadmium (Cd), mercury (Hg), aluminium (Al), gallium (Ga), indium (In), thallium (Tl), germanium (Ge), tin (Sn), and lead (Pb). Such metals can be recovered from various metal containing resources, in particular metal oxides, for example:

Low grade ores.

Sulfide ores.

Ocean floor nodule ores.

Ores that are difficult to process with present technologies as the valuable metals are bounded to silicates e.g. laterite ores containing nickel or cobalt.

Process slag from the metallurgical industry. Slag from primarily steel plants producing high alloyed steels, such as tool steels and stainless steels, contains appreciable amounts of valuable metals, such as chromium, nickel, molybdenum, vanadium, cobalt and tungsten. This slag is presently dumped, which is an environmentally unsuitable method and a waste of valuable and limited resources.

Mill scale obtained at hot forming of high alloyed steels, such as tool steels, high-speed steels and stainless steels.

Scrap containing valuable elemental metals, e.g. of cemented carbide containing more than 70% by weight of tungsten. "Cemented carbide", also called hardmetal, is a metal matrix composite where tungsten carbide particles are the aggregate and metallic cobalt serves as the matrix.

Dust from steel production having a combined amount of chromium and nickel of more than 5% by weight.

Electronic waste material such as circuit boards, components, displays.

The process for chlorinating resources containing recoverable metals as described in WO 2009/139715 A1 can easily be modified with an anode of liquid aluminum. Hence, WO 2009/139715 A1 is hereby incorporated by reference.

Whereas the invention has been shown and described in connection with the preferred embodiments thereof it will be understood that many modifications, substitutions, and additions may be made which are within the intended broad scope of the following claims.

For instance, a plurality of cathodes can be employed.

For instance, the anode can be provided by immersing an electrode in the liquid aluminum and connecting it to positive polarity during the electrolysis.

The invention claimed is:

1. A process for recovering at least one metal from a metal containing resource, said process including the steps of:

a) providing a crucible containing a chloride salt melt, at least one cathode and an anode connected to the salt melt, heating means for heating the salt melt, and an aluminum melt present at the bottom of the crucible, said aluminum melt forming the anode or a part of the anode, said salt melt being in direct contact with the cathode and the aluminum melt;

b) providing an initiating chlorine donor to the salt melt for starting the reactions in the salt melt, said initiating chloride donor being aluminum chloride and/or at least one metal chloride that can be electrolyzed in step f) to form aluminum chloride;

c) holding the temperature of the salt melt and the temperature of the aluminum melt at a temperature where both are in liquid phase;

d) introducing said metal containing resource into the liquid salt melt;

e) reacting the aluminum chloride as a chlorine donor with the metal containing resource to form at least one metal chloride being dissolved in the salt melt;

f) electrolyzing the salt melt, thereby forming the at least one metal at the cathode, optionally using a cathode bag, and forming aluminum chloride at the contact surface between the aluminum melt and the salt melt; and g) recovering at least one metal at the cathode or cathode bag.

2. The process according to claim 1, wherein the cathode is at least one first graphite electrode immersed in the salt melt.

3. The process according to claim 1, wherein a second graphite electrode is immersed in the aluminum melt, and connecting said second graphite electrode to positive polarity during the electrolysis.

4. The process according to claim 1 wherein the crucible is at least partly made in a conductive material, said conductive material being in contact with aluminum melt and connecting said conductive material to positive polarity during the electrolysis.

5. The process as claimed in claim 1, wherein the salt melt and the aluminum is held at a temperature above 660° C.

6. The process as claimed in claim 1, wherein the electrolysis includes selectively electrodepositing of the at least one metal.

7. The process as claimed in claim 1, wherein introducing said metal containing resource into said liquid salt melt stepwise or continuously, as said metal containing resource is being dissolved.

8. The process as claimed in claim 1, wherein the process is partly or wholly self-supporting during steady state by the aluminum chloride formed during the electrolyzing.

9. The process according to claim 1 wherein the salt melt initially consisting of a) 70-99% by weight of at least one chloride salt selected from the group consisting of alkali metal chlorides and alkaline earth metal chlorides, b) 1-20% by weight of the initiating chloride donor, and c) optionally 0-10% by weight of additional chlorides, and/or other halides, and/or sulfides and/or oxides.

10. The process as claimed in claim 9, wherein the at least one chloride salt partly or wholly consist of at least one of the salts selected from the group: NaCl, KCl, LiCl, $CaCl_2$.

11. The process as claimed in claim 9, wherein the at least one chloride salt includes by weight % of the at least one chloride salt, 3-20 Na, 30-70 KCl, 20-60 LiCl.

12. The process as claimed in claim 9, wherein the at least one chloride salt includes by weight % of the at least one chloride salt, 10-50 NaCl, 2-20 KCl, 50-80 $CaCl_2$.

13. The process as claimed in claim 9, wherein the at least one chloride salt includes by weight % of the at least one chloride salt, 5-20 NaCl, 20-40 LiCl, 40-70 $CaCl_2$.

14. The process as claimed in claim 9, wherein the at least one chloride salt includes by weight % of the salt composition, 35-65 KCl, 20-50 LiCl, 5-20 $CaCl_2$.

15. The process as claimed in claim 9, wherein the at least one chloride salt includes by weight % of the at least one chloride salt, 7-12 Na, 45-55 KCl, 35-45 LiCl.

16. The process as claimed in claim 9, wherein the at least one chloride salt includes by weight % of the at least one chloride salt, 25-35 NaCl, 3-10 KCl, 60-75 $CaCl_2$.

17. The process as claimed in claim 9, wherein the at least one chloride salt includes by weight % of the at least one chloride salt, 7-15 NaCl, 25-35 LiCl, 50-60 $CaCl_2$.

18. The process as claimed in claim 9, wherein the at least one chloride salt includes by weight % of the salt composition, 45-55 KCl, 30-40 LiCl, 10-15 $CaCl_2$.

19. The process according to claim 1, wherein said metal containing resource contains at least one metal oxide.

20. The process as claimed in claim 1, wherein the electrolyzing is performed for 2 to 8 hours.

21. The process according to claim 1, wherein the salt melt initially consisting of a) 70-95% by weight of at least one chloride salt selected from the group consisting of alkali metal chlorides and alkaline earth metal chlorides, b) 5-20% by weight of the initiating chloride donor, and -c) optionally 0-10% by weight of additional chlorides, and/or other halides, and/or sulfides and/or oxides.

* * * * *